US005906333A

United States Patent [19]

Fortuna et al.

[11] Patent Number: 5,906,333

[45] Date of Patent: May 25, 1999

[54] CENTER DRIVE UNWIND SYSTEM

[75] Inventors: Rudolph S. Fortuna; Larry E. Birnbaum; James D. Ba Dour, Jr., all of Green Bay; Paul K. Pauling, Appleton; James L. Baggot, Menasha, all of Wis.; David R. Gruber, Aiken, S.C.; Michael E. Daniels, Neenah, Wis.

[73] Assignee: Paper Converting Machine Company, Green Bay, Wis.

[21] Appl. No.: 08/838,278

[22] Filed: Apr. 16, 1997

[51] Int. Cl.[6] ..... B65H 19/12; B65H 19/16

[52] U.S. Cl. ..... 242/554.5; 242/555.2; 242/559.1; 242/563; 242/596.5

[58] Field of Search ..... 242/554, 554.5, 242/555.2, 559.1, 562.1, 564, 596.5, 563

[56] References Cited

U.S. PATENT DOCUMENTS

| | | | |
|---|---|---|---|
| 3,690,583 | 9/1972 | Herman | 242/559.1 |
| 3,740,296 | 6/1973 | McDonald . | |
| 3,743,198 | 7/1973 | Lucas . | |
| 4,021,002 | 5/1977 | Meihofer | 242/554 |
| 4,132,371 | 1/1979 | Byrt | 242/554 |
| 4,236,449 | 12/1980 | Price | 242/554 |
| 4,466,577 | 8/1984 | Focke et al. | 242/562.1 |
| 4,586,673 | 5/1986 | Tokuno et al. | 242/563 |
| 4,767,076 | 8/1988 | Tagawa . | |
| 4,773,609 | 9/1988 | Steffen et al. | 242/559.1 |
| 4,919,353 | 4/1990 | Isowa et al. | 242/559.1 |
| 5,004,173 | 4/1991 | Kawai . | |
| 5,025,998 | 6/1991 | Hutzenlaub et al. . | |
| 5,219,127 | 6/1993 | Boldrini et al. . | |

*Primary Examiner*—John M. Jillions

[57] ABSTRACT

A center driven unwind system including a pair of horizontally spaced-apart side frames defining the beginning of a path of travel of the web being unwound from a parent roll for processing by a rewinder, a U-shaped arm structure pivotally mounted adjacent the U-shape base on each side frame with each arm of the U-shape adjacent the arm free end being equipped with a retractable chuck for insertion into a parent roll core, a variable speed drive operably associated with each chuck and adapted to develop an increasing rotational speed characteristic in the chuck as a parent roll carried by the chuck is unwound, a core table positioned adjacent the frame and adapted to receive from the U-shaped arm structure a partially unwound parent roll, the core table being equipped with a cradle for rotatably supporting the partially unwound roll after the chucks have been retracted therefrom, sensors provided on the U-shaped arm structure for positioning the chucks for introduction into the core of a parent roll to be subsequently unwound, and a thread-up conveyor adjacent the core table for conducting a leading edge portion of a web from the parent roll to be subsequently unwound toward the tail end portion of a web from the partially unwound parent roll for simultaneous introduction into a rewinder.

34 Claims, 7 Drawing Sheets

R1
24
22
23
25
20
21
26

CENTER DRIVE UNWIND SYSTEM

BACKGROUND AND SUMMARY OF INVENTION

This invention relates to a center drive unwind system and, more particularly, to an unwind system especially advantageous in unwinding very large diameter parent rolls for subsequent rewinding into retail sized products.

Unwinds are used widely in the paper converting industry, particularly in the production of bathroom tissue and kitchen toweling. These hold parent rolls which are unwound for cross perforation and rewinding into retail-sized logs or rolls. At the time a parent roll runs out in a traditional operation, the spent shaft or core must be removed from the machine, and a new roll moved into position by various means such as an overhead crane, extended level rails, etc.

Historically, the unwinds made use of core plugs for support on unwind stands with the power for unwinding coming from belts on the parent roll surface. In contrast, center driving has been used mainly in film unwinding.

The down time associated with parent roll change represents a substantial reduction in total available run time and manpower required to change a parent roll, and hence reduces the maximum output that can be obtained from a rewinder line. The object of the invention is to dramatically reduce the time the machine is actually stopped, thus significantly improving overall efficiency, i.e., productivity while maintaining safety for all personnel.

According to the invention, the parent roll instead of being surface driven (via driven surface belts) is center driven (through the core). The invention provides an unwind stand including a pair of horizontally spaced apart side frames defining the beginning of a path of travel of the web being unwound from a parent roll for processing by a rewinder at the end of the path.

An elongated arm is pivotally mounted on each side frame with the mounting being adjacent one end of each arm and with each arm adjacent the other end being equipped with retractable chuck means for insertion into a parent roll core. Advantageously, the arms can be unitary—as part of a generally U-shaped arm means to insure stability and correspondence of operation.

Variable speed drive means are operably associated with each chuck means and are adapted to develop an increasing rotational speed characteristic in the chuck means as a parent roll carried by the chuck means is unwound. Sensor means are provided on the arms for positioning the chuck means for introduction into the core of a parent roll to be subsequently unwound.

The invention further includes the provision of a core table adjacent the frame adapted to receive from the arm means partially unwound parent roll. The core table is equipped with cradle means for rotatably supporting the partially unwound roll after the chuck means have been retracted therefrom.

Adjacent the end of the web path, i.e., adjacent the entering end of the rewinder, the invention includes means for combining the leading end portion of the web from the "new" parent roll with the trailing end portion of the substantially unwound parent roll for simultaneous introduction into the rewinder. In the illustrated embodiment, this advantageously is in the form of a thread-up conveyor utilizing vacuum.

So unlike the prior art where surface drive belts were used, there is the advantage of not contacting the surface of the parent roll when it is unwound. Other objects and advantages may be seen in the ensuing description.

BRIEF DESCRIPTION OF THE DRAWINGS

The invention is described in conjunction with the accompanying drawing, in which.

DETAILED DESCRIPTION

Figure 1:
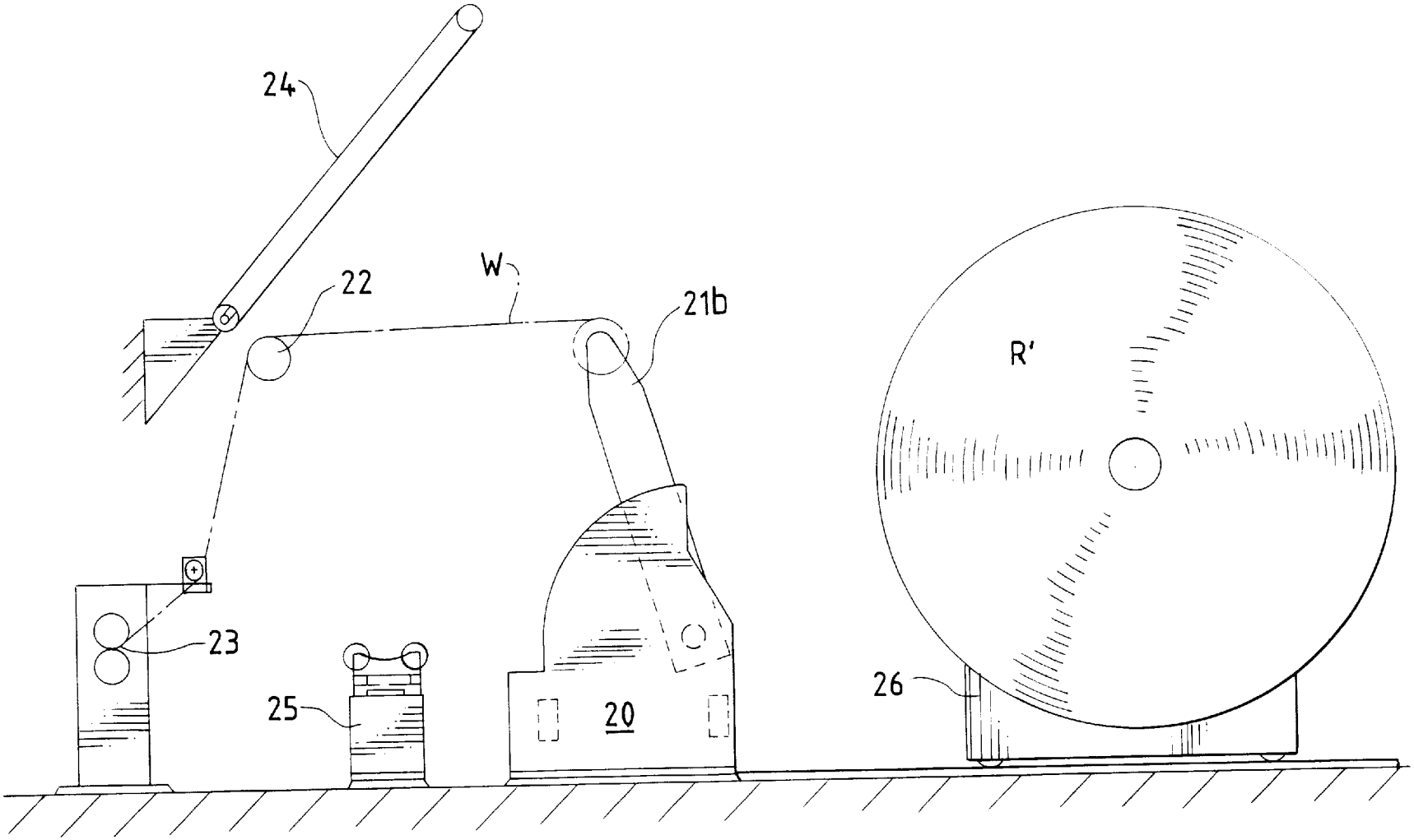
FIG. 1 is a schematic side elevational view of the inventive unwind system near the end of an unwind cycle.
Figure 2:
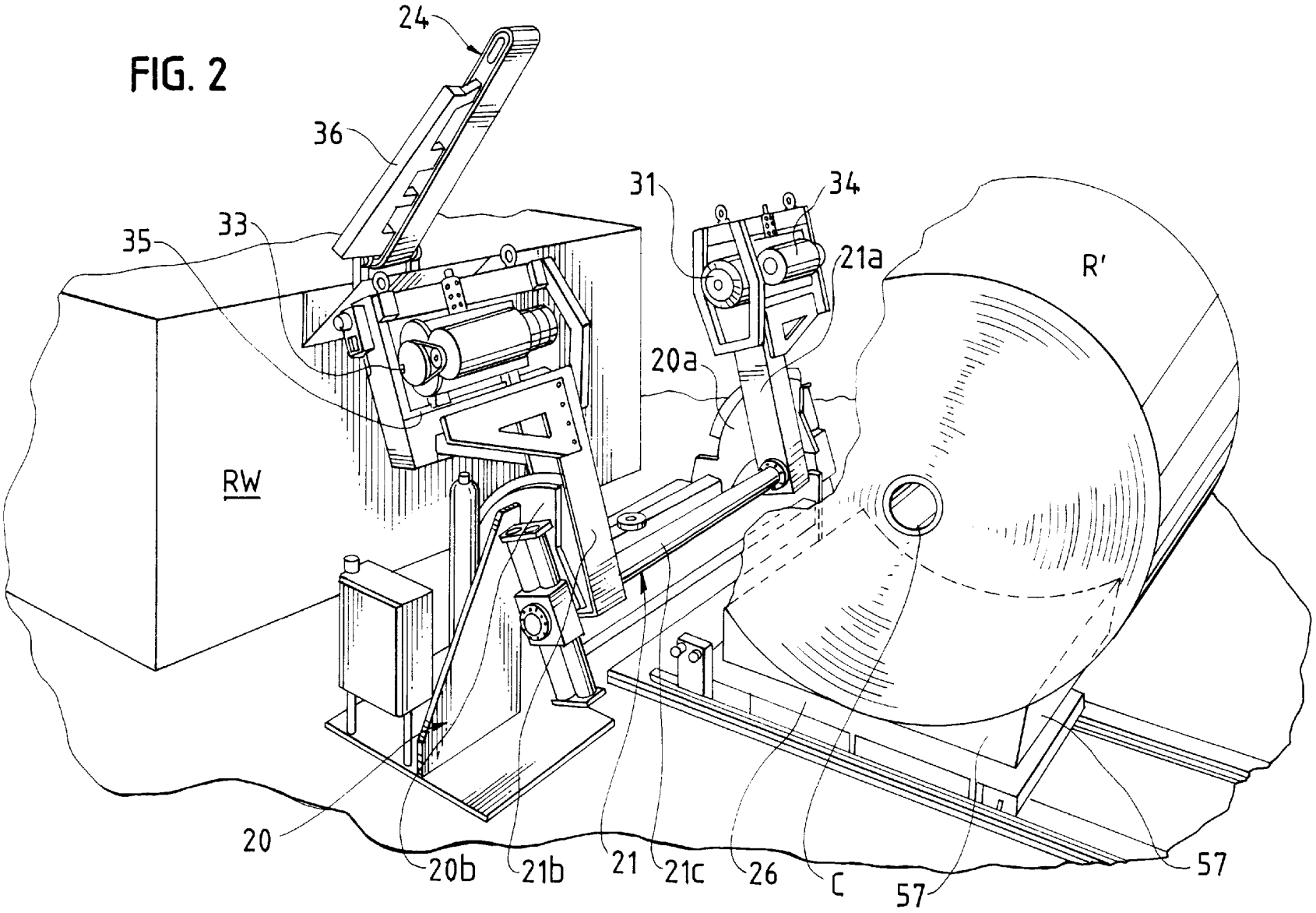
FIG. 2 is a perspective side elevational view of the unwind system of FIG. 1 in the form of a commercial prototype as seen from the upstream drive side, i.e., the side opposite the operator side—upstream referring to the start of the path or stream of the web and downstream being toward the rewinder.
Figure 3:
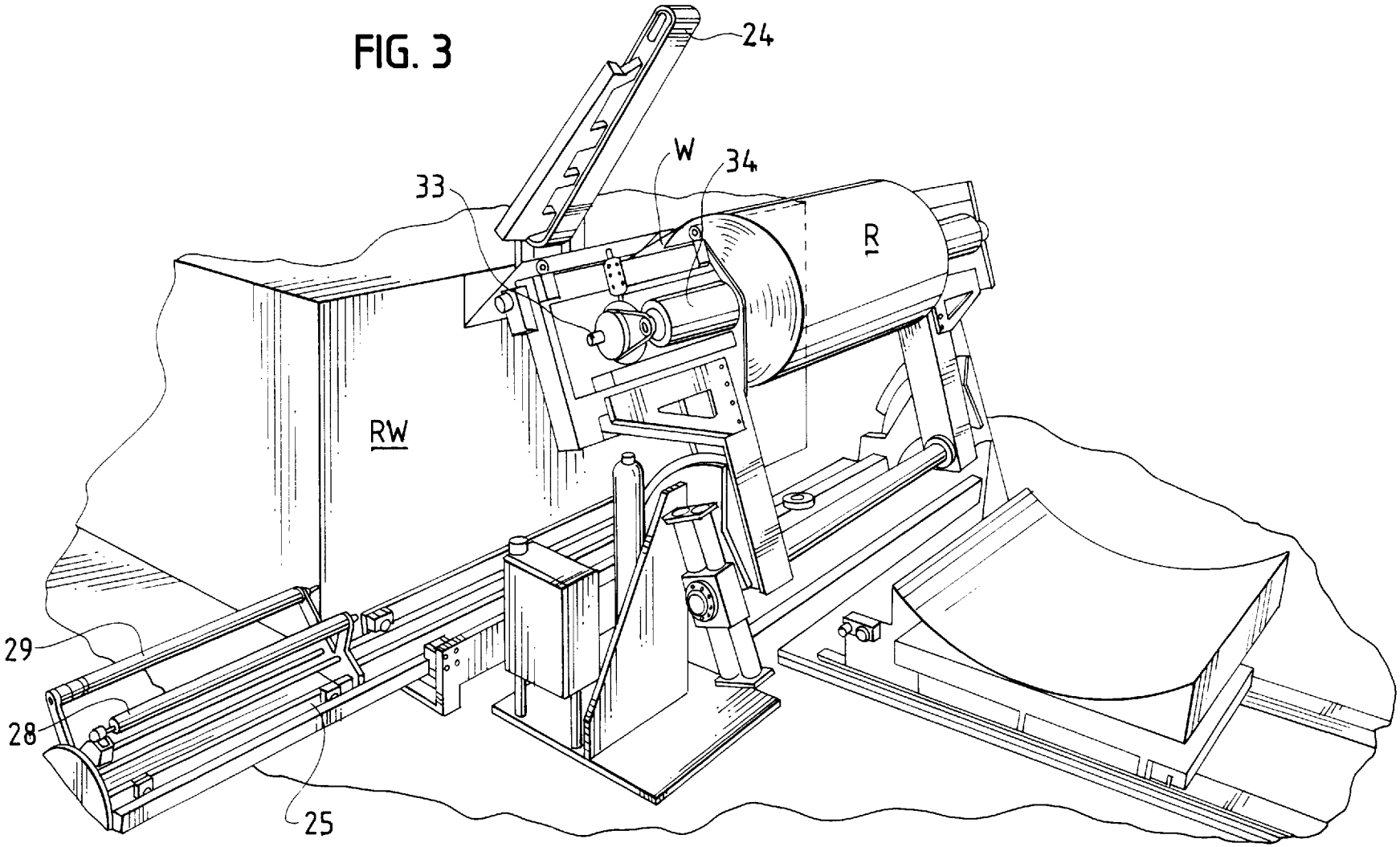
FIG. 3 is another perspective view of the unwind system but slightly more downstream than FIG. 2 and showing the unwind in the middle of an unwind cycle.
Figure 4:
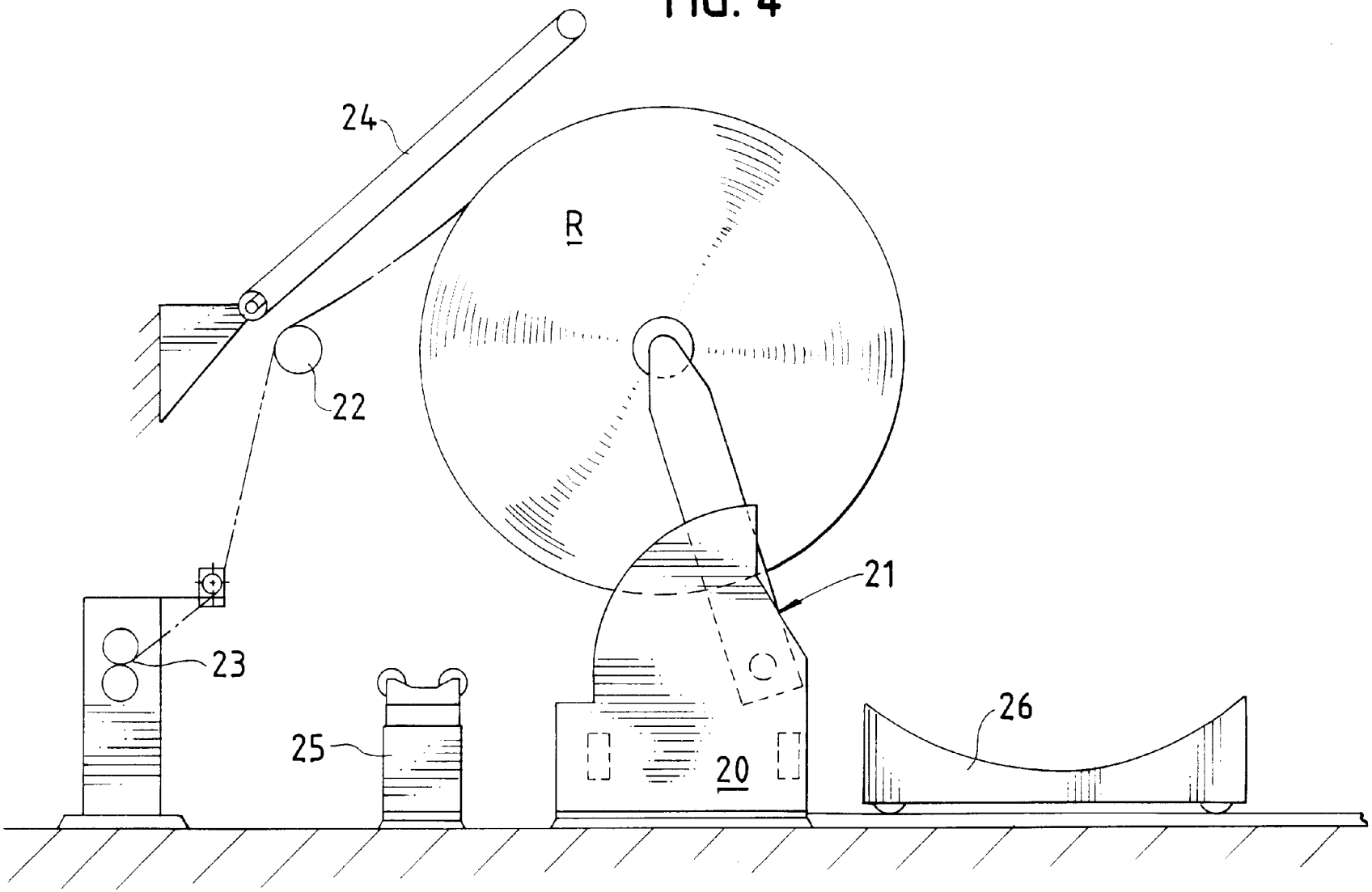
FIG. 4 is a schematic side elevational view corresponding to the perspective view of FIG. 3 but showing a full roll at the start of the unwinding cycle.
Figure 5:
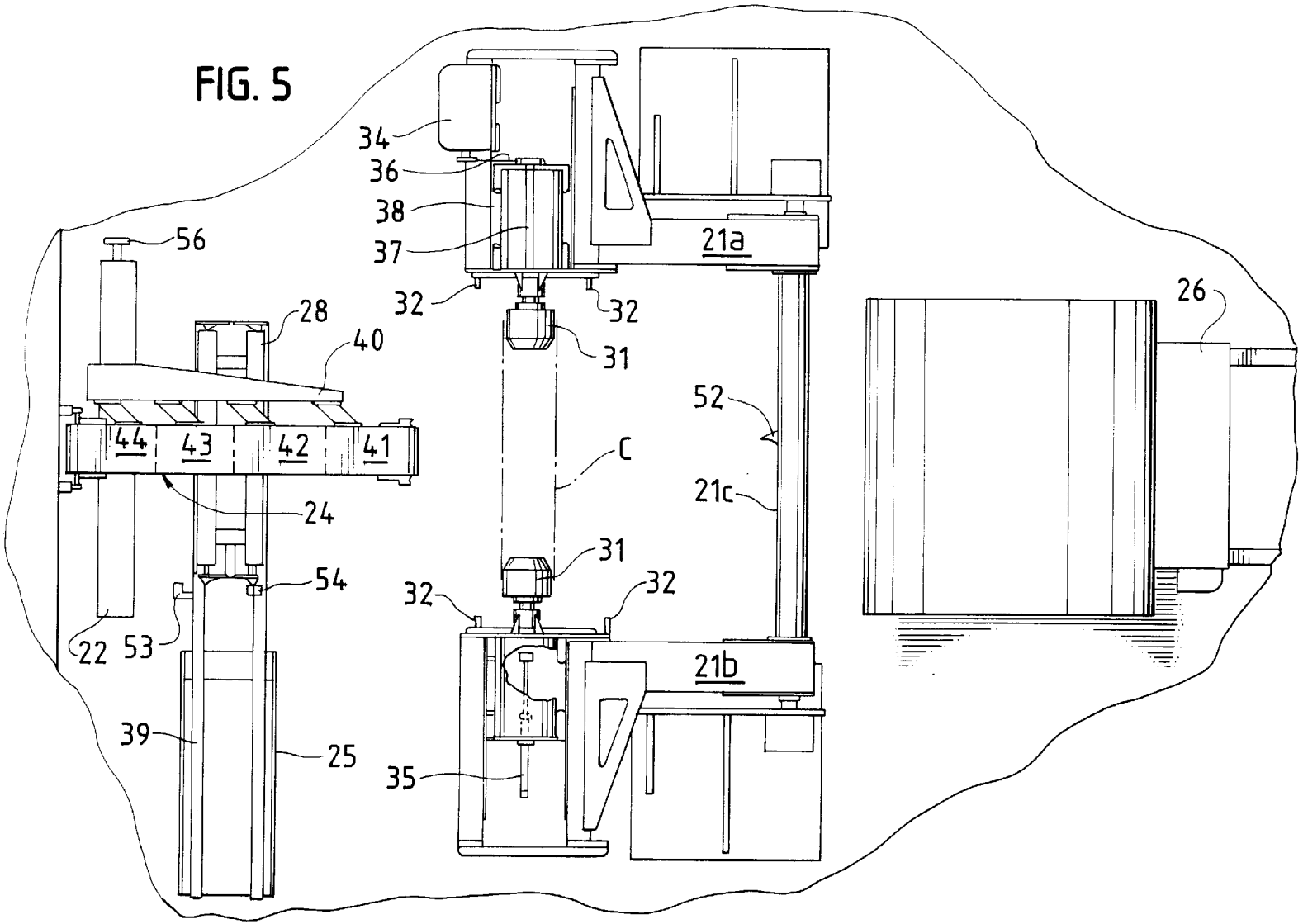
FIG. 5 is a top plan view of the unwind system as seen in the preceding views but with a portion broken away to reveal an otherwise hidden cylinder.

In the central part of FIGS. 1 and 2, the numeral 20 designates generally a frame for the unwind stand which includes a pair of side frames as at 20*a* and 20*b*—the latter being seen in the central portion of FIG. 2. The frame 20 pivotally supports arm means generally designated 21 and which is seen to be essentially U-shaped. The arm on the operating side is designated 21*a* while the arm on the drive side is designated 21*b*. Interconnecting and rigidifying the two arms is a transverse member 21*c*. The arms are seen to support a parent roll R which, as can be quickly appreciated from a consideration of FIGS. 3 and 4, is in the process of being unwound to provide a web W. The web W proceeds over a roller 22 (designated in the center left of FIG. 4) and into a bonding unit generally designated 23. These elements of the system are also seen in FIG. 5. The roller 22 may be an idler or driven.

Other elements depicted in FIGS. 1–4 are a thread-up conveyor generally designated 24, a core placement table generally designated 25 and a means 26 such as a cart for supporting a parent roll R' subsequently to be unwound—see FIGS. 1 and 2. In FIG. 2, the core C is clearly seen. Also, at the extreme left in FIGS. 2 and 3, a rewinder RW is seen to be at the downstream end of the system.

It is believed that the invention can be appreciated most quickly from an understanding of the sequence of operation which is depicted in FIGS. 1 and 6–11.

Sequence of Operation—Generally

FIG. 1

Figure 14:
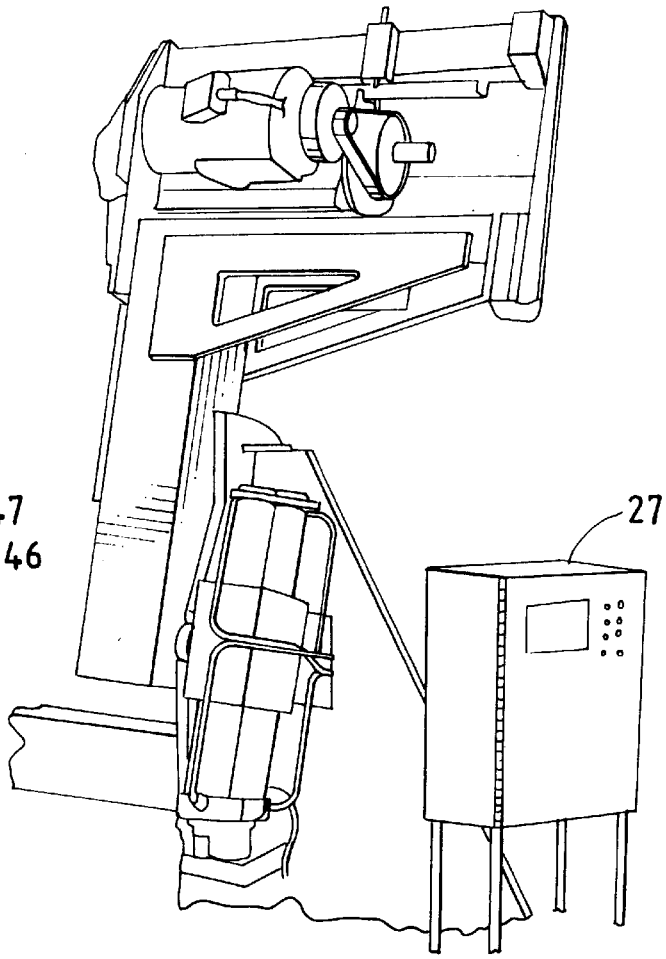
FIG. 14 is a fragmentary perspective view from the operator side of the unwind system and featuring the control means.

With the machine running and the diameter of the parent roll R decreasing, a deceleration diameter is calculated by a control means generally designated 27. In FIG. 2, this is partially obscured by the side frame 20*a* but can be seen clearly in FIG. 14.

When the parent roll diameter reaches this determined diameter, the unwind and associated equipment begin decelerating. During this time the core placement table 25 is aligned with the web center line of FIG. 2—having been in the standby position of FIG. 3.

FIG. 6

When all machine sections reach zero or a reduced speed and the core table 25 is confirmed empty, the core placement position of the arm means 21 is calculated which will set the expired parent roll $R_x$ slightly above or lightly on the cradle rollers 28, 29 of the core table 25. Advantageously, one of the cradle rollers—as at 28—is driven, while the other is an idler.

Figure 6:
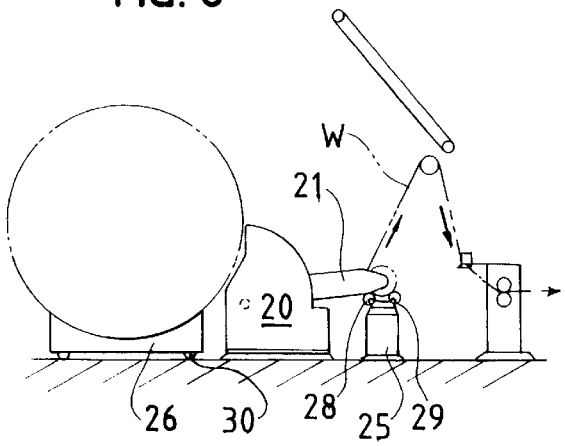
FIG. 6 is a schematic side elevational view similar to FIG. 1 but from the operator side and also showing the condition of the apparatus as a parent roll is almost completely unwound, i.e., slightly later in the operational sequence than FIG. 1.
Figure 7:
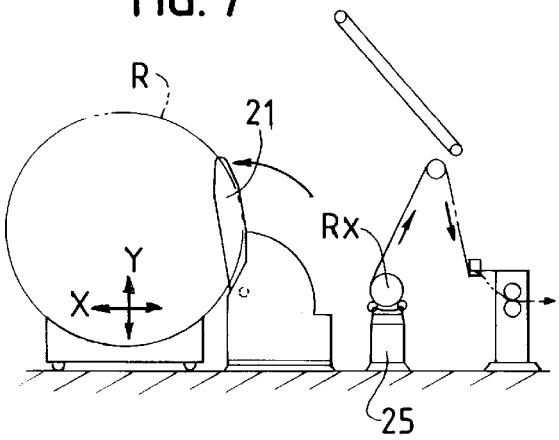
FIG. 7 is another sequence view now showing the beginning of the provision of a new parent roll.

The arm means 21 is now pivoted toward this calculated position—as shown in FIG. 6. As the arm means moves under the signal from the control means 27, the web W can be unwound in order to prevent web breakage. During this period the parent roll cart 26 (see FIG. 6) is moved into the unwind loading position.

The cart movement is based on previous roll diameter, measured diameter or an assumed diameter. The previous roll diameter is that of the last parent roll when loaded. So the assumption is that the new parent roll has the same diameter and so the position of the "old" roll is the one selected for the "new" roll. The "measured" diameter can be that as actually measured, either mechanically or manually. The "assumed" diameter is a constant value selected by the operator which is used repeatedly as coming near the actual diameter. In any event, this pre-positions the cart to minimize subsequent moves which, if needed, could frustrate the achievement of a one-minute or less roll change. The cart movement is under the control of control means 27. The object of the inventive unwind is to have its operation as automatic as possible—for both safety and efficiency.

The cart 26 may move into the position shown in the unwind along either the machine directional axis or the cross directional axis. However, the cart 26 is shown moving along the machine direction (see the wheels 30) in FIGS. 6–13 for conceptual clarity.

When the arm means 21 reaches the core drop position relative to the core table 25 as shown in FIG. 6, the core chucks 31 (see FIG. 5) are contracted by control means 27 which allows both of the core chucks 31 (see particularly FIG. 2) to be fully retracted out of the core C (compare FIGS. 6 and 7), and the expired parent roll $R_x$ placed onto the core table 25. Advantageously, the control means 27 is a Model PIC 900 available from Giddings and Lewis, located in Fond du Lac, Wis.

FIG. 7

As the arm means 21 moves toward this new position, photoelectric sensors 32 (see FIG. 5) which are mounted on the arm means 21, detect the edge of the parent roll loaded into the parent roll cart. When each sensor detects a parent roll edge, the angular position of the arm means 21 is recorded by the control means 27. Each data point along with known geometries and cart X-Y coordinates (see the designated arrows in FIG. 7) is used to calculate parent roll diameter and estimate X-Y coordinates of the center of the core C. Based on the core coordinates, the parent roll cart 26 is repositioned.

With the parent roll R repositioned and arm means 21 moving toward the parent roll loading position, the sensors 32 mounted on the arm means 21—see FIG. 5—will detect the leading and trailing edge of the core. As each sensor 32 detects an edge, the angular position of the associated pivot arm is recorded in the control means 27.

This data, along with known geometries, is used to calculate multiple X-Y coordinates of the center of the core. Coordinates are calculated separately for each end of the core. Averaging is used to obtain a best estimate of core coordinates for each end of the core.

The parent roll cart 26 is again repositioned to align the center of the core C and core chucks 31. If the cross directional axis of the core is properly aligned with the cross directional axis of the cart 26, both the core chucks 31 are extended into the core C and the chucks are expanded to contact the core. The expansion and contraction of the chuck means 31 is achieved by internal air operated bladders or other actuating means under signal from the control means 27. Air is delivered through a rotary union 33—see the central portion of FIG. 3.

FIG. 8

Figure 8:
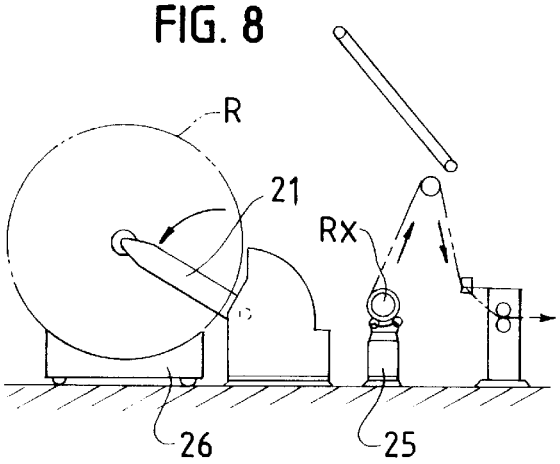
FIG. 8 is a view of the apparatus in its condition slightly later than that shown in FIG. 7.

FIG. 8 shows the arm means 21 in the loading position. If core skewing is excessive, the alignment of the parent roll core and core chucks must be individually performed on each end of the core. First, the arm means 21 and possibly the parent roll cart 26 are positioned so that one chuck 31 can be extended into the core C. Once in the core, the first chuck is expanded. Next, the parent roll cart 26 and/or arm means 21 is repositioned to align the remaining core chuck 31 with the core C. Once aligned, the second core chuck 31 is extended and expanded.

When fully chucked, regardless of the chucking process, the parent roll R is lifted slightly out of the cart 26. Then, the parent roll is driven, i.e., rotatably, by motors 34 which drive the chucks 31. Using motors on each arm evenly distributes the energy required. However, advantageous results can be obtained with motorizing only one of the chucks. Sufficient torque is applied by the core chuck drive motors 34 to test for slippage between a core chuck 31 and the core C. If slippage is detected, the parent roll is lowered back into the cart 26. The core chucks are contracted, removed from the core, and repositioned (i.e., "loaded") into the core. The core slippage test is then repeated. Multiple failures of this test can result in an operator fault being issued.

FIG. 9

Figure 9:
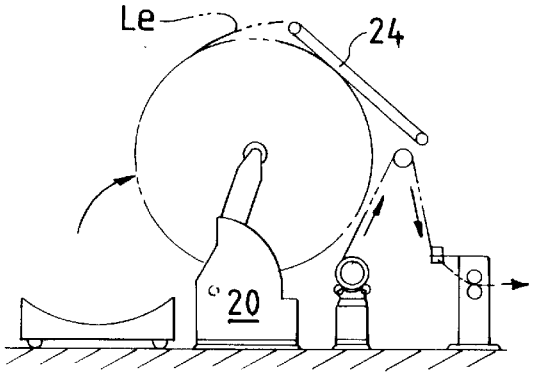
FIG. 9 is a view like the preceding views except that now a fully wound parent roll is installed in the unwind.

If no slippage is detected, arm means 21 is moved to the winding position, i.e., generally upright. As shown by FIG. 9, with the arm means in the run position, the vacuum thread up conveyor 24 is lowered onto parent roll and the vacuum is activated. The core chuck drive motors 34 rotate the parent roll R. The thread-up conveyor 24 operates at the same surface speed as the parent roll surface speed.

FIG. 10

Figure 10:
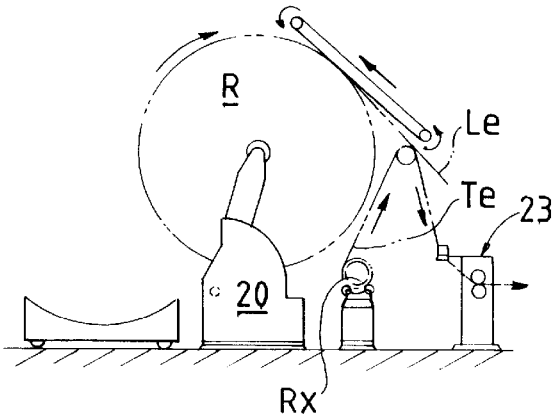
FIG. 10 is a view of the apparatus in a condition for coupling the leading edge portion of the new parent roll to the trailing tail portion of the almost expended parent roll.
Figure 11:
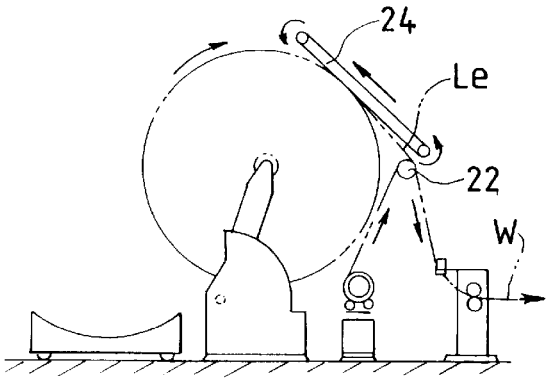
FIG. 11 is a view similar to FIG. 10 but now showing the two webs in the process of being bonded together.
Figure 13:
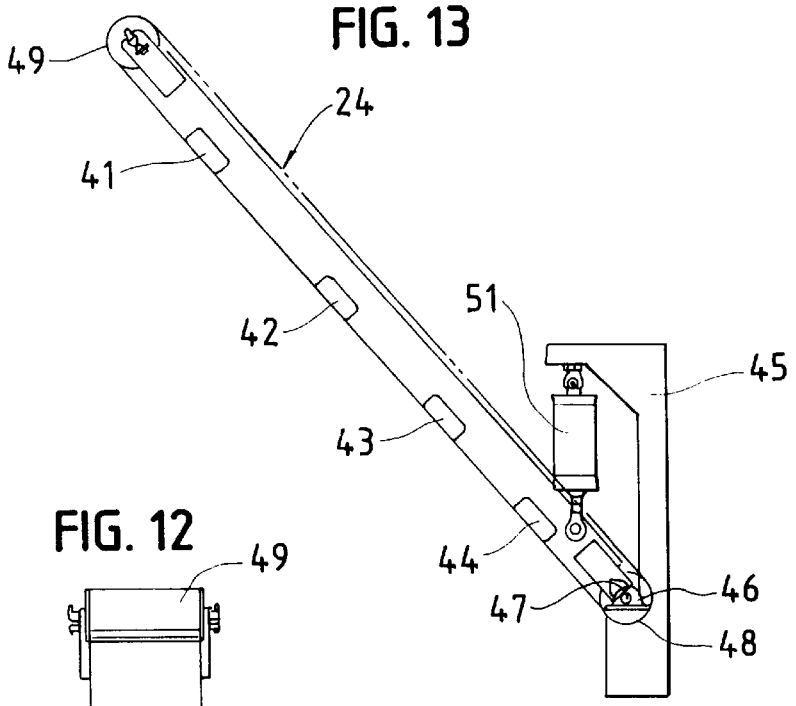
FIG. 13 is a side elevational view of the conveyor of FIG. 12.

Now referring to FIG. 10, when the leading end $L_e$ comes into contact with the vacuum conveyor 24, the tail is sucked up and pulled along by the vacuum thread up conveyor.

When the discharge end of the vacuum thread-up conveyor 24 is reached, the new web end portion $L_e$ drops onto the trailing end portion $T_e$ of the web from the expired parent roll $R_x$, depicted by FIG. 10. The rest of the machine line including the driven roller 28 is now brought up to match speed with that of the unwind.

FIG. 11

The new web is carried through the line with the web from the expired roll. The two webs can then be bonded together as at W in FIG. 11. An embossing-type method as at 23 is shown, but any method of web bonding could be used. After combining the webs, the web from the expired parent roll is no longer needed and brake means associated with the core table or roller 28 stops the expiring parent roll from turning and thus breaks the expired web. When appropriate, vacuum is removed and the vacuum thread-up conveyor is raised. The unwind now returns to previous running speeds. As the machine accelerates, the parent roll cart 26 is returned to its loading position for another roll and the core table is retracted to allow for core removal.

Control Means

The control means 27 performs a number of functions. First, in combination with the parent roll cart means 26, it calculates diameter and determines the position of the core C for positioning the cart means for insertion of the chuck means 31 into the parent roll core. Further, the control means 27 includes means cooperating with the sensor means 32 for calculating the coordinates of the parent roll core and averaging the coordinates prior to insertion of the chuck means 31. Still further, the control means includes further means for comparing the alignment of the core cross-directional axis with the parent roll cross-directional axis.

When all is aligned, the control means 27 operate the chuck means 31 for insertion into the core C by actuation of the cylinders 35 (see FIGS. 2 and 5). The control means 27 further causes expansion of the chuck means 31 in order to internally clamp the tubular core C. Relative to the insertion of the chuck means 31, the drive shaft of each motor 34 is offset from the axis of the associated chuck means 31 as can be seen in the left central part of FIG. 2 and the upper part of FIG. 5. There, the motor 34 is connected by a drive 36 to the shaft 37 of the chuck means 31. The shaft 37 is rotatably supported in the housing 38 of the chuck means 31. From the upper part of FIG. 5, it will be seen that the motor 34 is offset from the shaft 37 and from the lower part of FIG. 5 it will be seen that the cylinder 35 is responsible for moving the housing 38 and therefore the chuck means 31 into engagement with the core C.

During normal operation, the control means also calculates the deceleration diameter of the roll R being unwound, confirms the emptiness of the core table 25 and operates the arm means 21.

Core Table and Threadup Conveyor

Reference to FIG. 5 reveals that the core placement table 25 is mounted on rails 39 for advantageous removal during the unwind cycle. So if a web break occurs, the table is out of the web path so as not to interfere with clean-up. Also in FIG. 5 the thread-up conveyor 24 is seen to include a vacuum manifold 40 which provides a plurality of vacuum stages as at 41, 42, 43 and 44 of gradually less vacuum. The conveyor 24 is advantageously of screen or mesh construction to facilitate pickup of the leading edge portion of the web from the "new" parent roll.

Such a leading end portion may be folded to provide triangular shape to facilitate taping down. This helps prevent inadvertent detachment of the leading edge portion from the underlying ply during transfer of the parent roll from the paper machine to the site of rewinding. Normally, the first log rewound from a new parent roll is discarded so this eliminates the concern over a lumpy transfer.

As part of the program of operation of the unwind under the control of the control means 27, the conveyor 24 and vacuum from a pump (not shown) are both shut down to conserve energy and avoid unnecessary noise.

Figure 12:
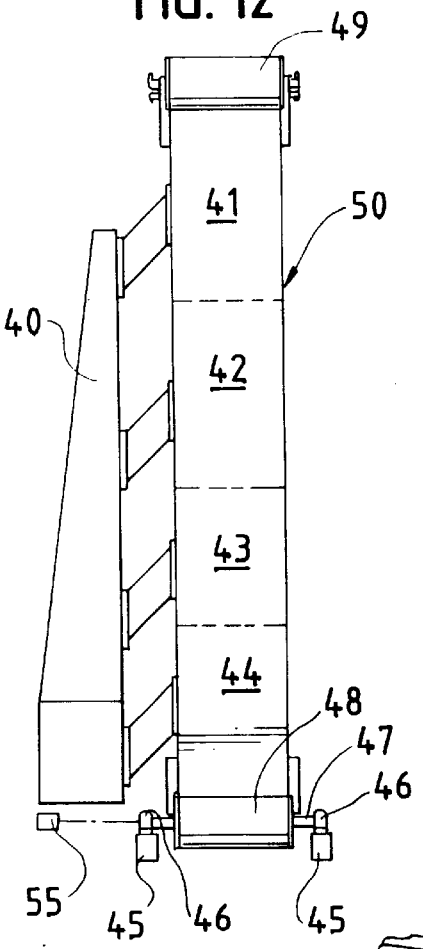
FIG. 12 is a top plan view of the thread-up conveyor.

The thread-up conveyor 24 is pivotally supported on a pair of pedestals 45 (see the right lower portion of FIG. 13) which provides a mounting 46 for each side of the conveyor 24—see FIG. 12. The mountings 46 rotatably carry a cross shaft 47 which is on the axis of the lower (driving) roller 48. At its upper end, the conveyor has an idler roller 49 supported on the staged chamber generally designated 50 which is coupled to the manifold 40.

Positioning of the conveyor 24 via changing its angle is achieved by a pair of pressure cylinders 51 coupled between the pedestals 45 and the chamber 50. The cylinders 51 are also under the control of the control means 27.

System Parameters

To enable the control means 27 to calculate the deceleration diameter near the end of the unwind cycle, a further sensor 52 is provided—this on the transverse member 21*c* of arm means 21, as seen in FIG. 5. In addition, the sensor continually reports the radius of the parent roll and the control means continually calculates the motor speed to obtain a desired unwind. Alternatively, process feedback such as load cells or dancers can be used to report to the control means changes in tension or the like and enable the control means to vary the motor speed.

Once the rewinder is located—a primary consideration because of its involvement with the core hopper, core feed, log removal and log saw, the unwind frame 20 is placed a suitable distance upstream to accommodate the core placement table 25, the thread-up conveyor 24 and any bonding unit 23.

The location of the core placement table 25 is a function of the pivot geometry of the arm means 21 as can be appreciated from a consideration of FIG. 6. On the other hand, the location of the thread-up conveyor 24 is not only a function of the arm means geometry but also the size parent rolls to be unwound.

In a similar fashion to the location of the core table 25, the cart 26 must be placeable to have the parent roll engageable by the chucks 31 of the arm means 21.

The unwind system, although having a means for actually rotating the parent roll, really includes a path or section of a mill's converting area extending from the cart means 26 which provides the next parent roll, all the way to the rewinder proper.

Structural Features

The inventive system includes many novel features which are discussed below. For example, the invention contemplates the use of roll cart means 26 operably associated with the frame 20 for supporting a "new" parent roll R', the means 26 cooperating with the control means 27 also operably associated with the frame 20 for positioning chuck means 31 for inserting the same into a parent roll core C.

Further, the control means 27 includes sensor means 32 cooperatively coupled together for calculating the coordinates of the "new" parent roll R' and averaging the coordinates prior to insertion of the chuck means 31.

Still further, the control means 27 includes the capability to compare the alignment of the core cross directional with the parent roll cross directional axis. The control means capability also includes the controlling of the insertion of the chuck means 31 into the core C—as by, for example, controlling the operation of the fluid pressure cylinders 35.

Near the end of the unwinding cycle, the control means 27 regulate the pivotal movement of the arm means 21 as a function of the degree of unwinding of the parent roll R. Also during the unwinding cycle (during its last stages generally), the control means 27 in combination with sensing means 53 determines the condition of the core placement table 25—see the left center portion of FIG. 5.

Near the very end of the unwinding cycle it is important for the core placement table to be in position to receive the almost-expired roll $R_x$, be free of any obstructing material and also have its rotating roller 28 in operation. But at the very end, motor and brake means 54 operably associated with the roller 28 are energized to snap off the web W—and with a minimum of web tail retained on the table 25—optimally about ¼" (6 mm).

Prior to the time referred to immediately above, but again toward the end of an unwinding cycle, the control means actuates the thread-up conveyor 24 via a drive 55—see the lower left of FIG. 12. The drive 55 is coupled to the drive 56 of the driven roller 22 (see FIG. 5) which, in time, is driven by a motor (not shown). Also, there is actuation of a vacuum pump (not shown) to apply a reduced pressure to the manifold 40.

SUMMARY

As indicated above, the unwind system for large diameter parent rolls, is completely automated to avoid the need for manual handling of cumbersome and potentially dangerous rolls.

At the outset, the cart 26 is advantageously equipped with an upper table 57 (see FIG. 2) which is rotatable about a vertical axis through an arc of 90° to permit cantilever delivery of a new parent roll whose axis is parallel to the length of the web path, i.e., from cart 26 to bonding station 23. The controller 27 thereupon causes the table 57 to rotate to the FIGS. 2 and 3 showings for commencing the unwind cycle.

As the previous parent roll nears expiration, the arm means 21—which have been detached from the previous roll core are automatically pivoted from downstream to upstream and the chucking of the core performed automatically as descried above.

Then, at the end of the cycle, the depleted core is deposited on the table 25 and the arm means 21 unchucked for the initiation of another cycle.

While in the foregoing specification, a detailed description of an embodiment of the invention has been set down for the purpose of illustration, many variations in the details hereingiven may be made by those skilled in the art without departing from the spirit and scope of the invention.

We claim:

1. A center driven unwind system for core-equipped parent rolls comprising a frame including a pair of horizontally spaced apart side frames defining the beginning of a path of travel of the web unwound from a core-equipped parent roll for processing by a rewinder at the end of said path, an elongated arm pivotally mounted adjacent one arm end on each side frame, each arm adjacent the other arm end being equipped with retractable chuck means for insertion into a parent roll core, variable speed drive means operably associated with said chuck means adapted to develop an increasing rotational speed characteristic in said chuck means as a parent roll carried by said chuck means is unwound, sensor means on said arms for positioning said chuck means for introduction into the core of a parent roll to be subsequently unwound, a core table adjacent said frame adapted to receive from said arms a partially unwound parent roll, said core table being equipped with cradle means for rotatably supporting said partially unwound parent roll after said chuck means has been retracted therefrom, and means operably associated with said core table for affixing the leading end portion of said subsequent parent roll to the trailing end portion of said partially unwound parent roll for simultaneous introduction into said rewinder.

2. The unwind system of claim 1 in which parent roll cart means are operably associated with said frame for supporting a new parent roll, and control means also operably associated with said frame for determining the position of said core for positioning said chuck means for insertion of said chuck means into said parent roll core.

3. The unwind system of claim 2 in which said control means includes means cooperatively coupled to said sensor means for calculating the coordinates of said parent roll core and averaging said coordinates prior to insertion of said chuck means.

4. The unwind system of claim 3 in which said cart means has a cross directional axis and said parent roll core has a cross directional axis, said control means including means for comparing the alignment of said core cross directional axis with said cart means cross directional axis.

5. The unwind system of claim 4 in which said comparing means includes sensor means on each arm.

6. The unwind system of claim 1 in which control means are operably associated with said frame for controlling the insertion of said chuck means in said core.

7. The unwind system of claim 6 in which each arm is equipped with cylinder means for operating its associated chuck means.

8. The unwind system of claim 1 in which said control means include means for calculating the diameter of said parent roll when deceleration is required.

9. The unwind system of claim 8 in which said calculating means includes sensor means operably associated with said arms.

10. The unwind system of claim 1 in which control means are operably associated with said frame for controlling the pivotal movement of said arms as a function of degree of unwinding of said parent roll.

11. The unwind system of claim 10 in which said control means is equipped with means for determining the condition of said core table.

12. The unwind system of claim 11 in which said control means is equipped with means for operating said core table cradle means to minimize the amount of unwound web on said core.

13. The unwind system of claim 1 in which said end affixing means includes a thread-up conveyor means.

14. The unwind system of claim 13 in which said control means is equipped with means for controlling the operation of said thread-up conveyor means.

15. The unwind system of claim 13 in which said thread-up conveyor means is equipped with endless screen belt means and vacuum means operably associated with said belt means.

16. The unwind system of claim 15 in which said vacuum means is staged to apply the maximum vacuum to the first portion of said belt means contacting said leading edge portion.

17. The unwind system of claim 16 in which said belt means has upper and lower runs with said staged vacuum means including a plurality of chamber means interposed between said upper and lower runs.

18. The unwind system of claim 1 in which web bonding means is provided adjacent said path for uniting said leading end portion with said tail end portion.

19. An unwind system for core-equipped parent rolls comprising an elongated path of travel of the web to be unwound from a core-equipped new parent roll for processing by a rewinder at the end of said path, cart means first in said path for supplying said new parent roll, pivotally movable U-shaped arm means next in said path, said U-shape providing free arm end portions with each arm end portion being equipped with retractable chuck for insertion into a parent roll core, variable speed drive means operably associated with at least one chuck adapted to develop an increasing rotational speed characteristic in said chuck as a parent roll carried by said chucks is unwound, sensor means on said arm means for positioning said chucks for introduction into the core of a parent roll to be subsequently unwound, a core table next in said path adapted to receive from said arm means a substantially unwound parent roll, said core table being equipped with cradle means for rotatably supporting said substantially unwound parent roll after said chucks have been retracted therefrom, and means next in said path for affixing the leading end portion of said new parent roll to the trailing end portion of said substantially unwound parent roll for simultaneous introduction into a rewinder.

20. The unwind system of claim 19 in which said affixing means includes a thread-up conveyor.

21. The unwind system of claim 20 which includes a roller in said path generally aligned with said thread-up conveyor for supporting said trailing end portion of the web from said core table.

22. The unwind system of claim 21 in which bonding means are interposed in said path between said thread-up conveyor and said rewinder whereby said leading end and trailing end portions are simultaneously introduced into said rewinder.

23. The unwind system of claim 20 in which said thread-up conveyor includes endless screen belt means with vacuum means operably associated with said belt means.

24. The unwind system of claim 23 in which said endless screen belt means is relatively elongated to include upper and lower runs, said vacuum means including a relatively elongated chamber positioned between said upper and lower runs.

25. The unwind system of claim 24 in which said vacuum chamber has a plurality of stages with the highest vacuum stage being first in said path.

26. The unwind system of claim 19 in which said cart means includes further means for positioning said new parent roll with the core thereof in alignment with said chucks.

27. The unwind system of claim 26 in which said new parent roll positioning means includes wheels for positioning said cart means relative to said U-shaped arm means.

28. The unwind system of claim 19 in which said core table is equipped with means for moving the same transversely of said path to remove said core table from under said web.

29. An unwind system for core-equipped parent rolls comprising an elongated path of travel of the web to be unwound from a core-equipped new parent roll for processing by a rewinder at the end of said path, means first in said path for supplying said new parent roll, pivotable U-shaped arm means next in said path, said U-shape providing free arm end portions and with each arm end portion being equipped with a retractable chuck for insertion into a parent roll core, sensor means on said arm means for positioning said chucks for introduction into the core of said new parent roll, variable speed drive means operably associated with each arm end for developing an increasing rotational speed characteristic in said chuck as a parent roll carried by said chucks is unwound, control means operably associated with said path for controlling the insertion of said chucks into said core and for controlling the pivotal position of said arm means, means operably associated with said path for combining the leading end portion of said new parent roll with the trailing end portion of an expiring parent roll, and a rotating roller-equipped core table positioned next in said path after said arm means, said core table being adapted to receive from said arm means a partially unwound parent roll, said control means being equipped with means for (a) sensing the condition of said core table and (b) coordinating the pivotal position of said arm means with the rotation of said core table roller.

30. The unwind system of claim 29 in which said core table is equipped with means for rotating and braking said roller, said control means including means for actuating said rotating and braking means when the trailing end of the web on said expiring roll is reached.

31. An unwind system for core-equipped parent rolls comprising an elongated path of travel of the web to be unwound from a core-equipped new parent roll for processing by a rewinder at the end of said path, means first in said path for supplying said new parent roll, pivotable U-shaped arm means next in said path, said U-shape providing free arm end portions and with each arm end portion being equipped with a retractable chuck for insertion into a parent roll core, sensor means on said arm means for positioning said chucks for introduction into the core of said new parent roll, variable speed drive means operably associated with each arm end for developing an increasing rotational speed characteristic in said chuck as a parent roll carried by said chucks is unwound, control means operably associated with said path for controlling the insertion of said chucks into said core and for controlling the pivotal position of said arm means, means operably associated with said path for combining the leading end portion of said new parent roll with the trailing end portion of an expiring parent roll, and a core table positioned next in said path after said arm means and roller means positioned next in said path after said core table, said core table being adapted to receive from said arm means a partially unwound parent roll.

32. The unwind system of claim 31 in which a thread-up conveyor is positioned generally above said roller means.

33. The unwind system of claim 32 in which said control means is equipped with means for coordinating the operation of said core table and thread-up conveyor.

34. The unwind system of claim 32 in which drive means connect said roller means and said thread-up conveyor.

* * * * *